US010743724B2

(12) United States Patent
deLoache, III et al.

(10) Patent No.: US 10,743,724 B2
(45) Date of Patent: Aug. 18, 2020

(54) LIGATURE-RESISTANT TOILET PAPER DISPENSER

(71) Applicant: BEHAVIORAL SAFETY PRODUCTS, LLC, Athens, GA (US)

(72) Inventors: Robert Lee deLoache, III, Watkinsville, GA (US); David Cory deLoache, Watkinsville, GA (US); Mark Mendes, Loganville, GA (US)

(73) Assignee: BEHAVIORAL SAFETY PRODUCTS, LLC, Athens, GA (US)

( * ) Notice: Subject to any disclaimer, the term of this patent is extended or adjusted under 35 U.S.C. 154(b) by 0 days.

(21) Appl. No.: 16/545,317

(22) Filed: Aug. 20, 2019

(65) Prior Publication Data

US 2019/0374076 A1 Dec. 12, 2019

Related U.S. Application Data

(63) Continuation-in-part of application No. 15/987,295, filed on May 23, 2018.

(51) Int. Cl.

| | |
|---|---|
| ***A47K 10/38*** | (2006.01) |
| ***A47K 13/24*** | (2006.01) |
| ***A47K 10/32*** | (2006.01) |

(52) U.S. Cl.

CPC ..... *A47K 10/3818* (2013.01); *A47K 13/242* (2013.01); *A47K 2010/3233* (2013.01)

(58) Field of Classification Search

CPC ..... A47K 10/3836; A47K 10/3818; A47K 2010/3233

See application file for complete search history.

(56) References Cited

U.S. PATENT DOCUMENTS

| | | | |
|---|---|---|---|
| 1,815,855 | A | 7/1931 | Lauritano |
| 2,650,948 | A | 9/1953 | Findlay |

(Continued)

FOREIGN PATENT DOCUMENTS

| | | |
|---|---|---|
| CN | 101484056 B | 5/2011 |
| FR | 2432293 | 2/1980 |

(Continued)

OTHER PUBLICATIONS

U.S. Appl. No. 15/987,295, filed May 23, 2018, deLoache, III, et al.

(Continued)

*Primary Examiner* — William A. Rivera

(74) *Attorney, Agent, or Firm* — Mitch Harris, Atty at Law LLC; Andrew M. Harris

(57) ABSTRACT

A ligature-resistant toilet paper dispenser includes a cover portion with a paper recess for receiving a roll of toilet paper and a wall plate having a planar mounting area for securing the toilet paper dispenser to a wall. The cover locks to the rear portion, covers the roll and completes the shape of the toilet paper dispenser exterior. The wall plate has an upward projecting exterior that is curved or inclined downward from an apex to prevent attachment of a ligature and extends above the paper recess by a distance greater than or equal to half of a maximum forward projection of the wall plate to provide sufficient curvature or inclination of the exterior of the top projection.

20 Claims, 12 Drawing Sheets

(56) References Cited

U.S. PATENT DOCUMENTS

| | | | | |
|---|---|---|---|---|
| 2,805,112 | A * | 9/1957 | Krueger | A47K 10/38 312/242 |
| 2,860,348 | A | 11/1958 | McClenahan | |
| 3,331,106 | A | 7/1967 | Ruskin | |
| 3,495,276 | A | 2/1970 | Suess | |
| 3,573,344 | A | 4/1971 | Snyder | |
| 3,729,113 | A | 4/1973 | Lopatka | |
| 3,890,459 | A | 6/1975 | Caveney | |
| 3,901,406 | A | 8/1975 | Kivett | |
| 3,924,279 | A | 12/1975 | Morris et al. | |
| 3,987,502 | A | 10/1976 | Hartmann | |
| D261,799 | S | 11/1981 | Alger | |
| D264,620 | S | 5/1982 | Kaiser | |
| 4,558,472 | A | 12/1985 | Fromme et al. | |
| D284,303 | S | 6/1986 | Yvetot | |
| 4,719,321 | A | 1/1988 | Kozel et al. | |
| 4,775,121 | A | 10/1988 | Carty | |
| D308,819 | S | 6/1990 | Anscher | |
| D311,242 | S | 10/1990 | Reid | |
| 4,962,550 | A | 10/1990 | Ikenaga et al. | |
| 5,210,913 | A | 5/1993 | Clark | |
| 5,224,674 | A | 7/1993 | Simons | |
| 5,251,340 | A | 10/1993 | Su-Land | |
| 5,389,082 | A | 2/1995 | Baugues et al. | |
| 5,649,676 | A * | 7/1997 | Lord | A47K 10/3827 242/595 |
| 5,680,949 | A | 10/1997 | Roesler | |
| 5,795,335 | A | 8/1998 | Zinreich | |
| 5,870,805 | A | 2/1999 | Kandler et al. | |
| 5,913,692 | A | 6/1999 | Targett | |
| D412,974 | S | 8/1999 | Birsel et al. | |
| 6,099,340 | A | 8/2000 | Florentine | |
| 6,129,109 | A | 10/2000 | Humber | |
| D438,939 | S | 3/2001 | Kawamura | |
| D450,570 | S | 11/2001 | Murata | |
| 6,687,922 | B1 | 2/2004 | Marshall et al. | |
| 6,736,669 | B1 | 5/2004 | Martin et al. | |
| 6,908,059 | B2 | 6/2005 | Budz et al. | |
| D509,575 | S | 9/2005 | Kergoet | |
| D539,232 | S | 3/2007 | Lozano | |
| 7,457,506 | B1 | 11/2008 | Osborne, II | |
| 7,565,706 | B2 | 7/2009 | Janssen | |
| D597,493 | S | 8/2009 | Wu | |
| D644,501 | S | 9/2011 | Chen | |
| D680,083 | S | 4/2013 | Olson | |
| D706,225 | S | 6/2014 | deLoache, III | |
| D733,270 | S | 6/2015 | Hao | |
| 9,297,154 | B2 | 3/2016 | deLoache, III | |
| 9,309,993 | B2 | 4/2016 | Hall | |
| 9,585,528 | B2 | 3/2017 | Khamphilapanyo et al. | |
| D792,955 | S | 7/2017 | deLoache, III | |
| 9,938,704 | B2 | 4/2018 | deLoache, III | |
| 2004/0135039 | A1 | 7/2004 | Reichert et al. | |
| 2005/0189453 | A1 | 9/2005 | DeGuevara | |
| 2006/0102769 | A1* | 5/2006 | Wieser | A47K 10/38 242/560 |
| 2011/0308046 | A1 | 12/2011 | Weiss | |
| 2013/0240660 | A1* | 9/2013 | Greer | A47K 10/3836 242/597.5 |
| 2016/0174778 | A1* | 6/2016 | Khamphilapanyo | B26F 3/02 312/349 |
| 2018/0020886 | A1 | 1/2018 | Boeltl | |
| 2018/0135286 | A1 | 5/2018 | deLoache, III | |
| 2019/0191934 | A1* | 6/2019 | Miedzius | A47K 5/1207 |
| 2020/0069121 | A1* | 3/2020 | Boeltl | A47K 10/424 |

FOREIGN PATENT DOCUMENTS

| | | |
|---|---|---|
| FR | 2667854 | 8/1993 |
| KR | 19940008645 | 5/1994 |

OTHER PUBLICATIONS

Cape Cod Systems, "Paper Towel Dispensers" downloaded from https://www.capecodsystemscompany.com/store/paper-towel-dispensers,category.asp on Mar. 23, 2018, 7 pages (pp. 1-7 in pdf).

Kingsway Group, "KGO2 Ligature Resistant Paper Towel Dispenser" downloaded from http://www.kingswaygroupglobal.com/products/kg02-ligature-resistant-paper-towel-dispenser/ on Mar. 23, 2018, 4 pages (pp. 1-4 in pdf).

Sustainable Supply, "Georgia Pacific CenterPull Hand Towel Dispenser" downloaded from https://www.sustainablesupply.com/Georgia-Pacific-CenterPull-Hand-Towel-Dispenser-9-1-4w-x-8-3-4d-x-11-1-2h-Smoke-GPC582-04-C1958890?CAWELAID=12020504000206167 6&CAGPSPN=pla&CAAGID=41281995749&CATCI=pla-374717576338&gclid=Cj0KCQjwre_XBRDVARIsAPf7zZh-jhIA7rxGRHdPTzTMZYkX8wZuAa1qQGShbF6OV6vErm4gG6eQ8moaAqlyEALw_wcB on Mar. 23, 2018, 1 page.

Restroom Direct, "Bradley 234-000000 Paper Towel Dispenser & Waste Receptacle", downloaded from http://www.restroomdirect.com/bradley-234-combo-dispenser-waste.aspx?gclid=Cj0KCQjw0PTXBRCGARIsAKNYfGotjQqlsCfQV1gO0BM3CBWyu1yU8UAfTTbkablh6fi9j19mdc_9IAaAqqgEALw_wcB on May 17, 2018, 3 pages (pp. 1-3 in pdf).

* cited by examiner

LIGATURE-RESISTANT TOILET PAPER DISPENSER

This U.S. Patent Application is a Continuation-in-part of U.S. patent application Ser. No. 15/987,295, filed on May 23, 2018, and claims priority thereto under 35 U.S.C. § 120. The disclosure of the above-referenced U.S. Patent Application is incorporated herein by reference.

BACKGROUND OF THE INVENTION

1. Field of the Invention

The present invention relates generally to toilet paper dispensers, and in particular, to a toilet paper dispenser around which a ligature does not anchor.

2. Description of the Related Art

Ligature-resistant design is a requirement in many institutional locations. In particular, in rooms where persons may be left unattended and where there is a risk that fixtures may be used as a support to tie a ligature, such as a belt, rope or a cloth, a way to ensure that the fixtures cannot be used in such a manner is desirable. In general, ligature-resistant design is an issue that exists any height above the floor, since objects above the floor can be used to support a ligature, even if one is not attachable.

Toilet paper dispensers having locking features are in common-use in public places and private facilities such as hospitals, mental health facilities and incarceration facilities. In such private facilities it is desirable to secure toilet paper rolls for both use conservation and sanitation, as in public facilities. Commercial toilet paper dispensers are not suitable ligature-resistant designs and typically provide a broad upper surface and a gap between the dispenser and wall around which a ligature can be attached.

Therefore, it would be desirable to provide a toilet paper dispenser that prevents ligature formation and/or support of such ligatures.

SUMMARY OF THE INVENTION

The above objectives, among others, are achieved in a ligature-resistant toilet paper dispenser and a method of dispensing toilet paper.

The ligature-resistant toilet paper dispenser includes a wall plate and a cover rotatably connected to the wall plate by a hinge, so that the cover may be rotated away from the wall plate to expose the roll of toilet paper, which rests on an inner bottom surface of the cover. The wall plate has a planar mounting area extending over a rear surface of the wall plate for securing the toilet paper dispenser to a wall. The cover covers the wall plate, and has a roll cover portion extending upward from a bottom of the cover that, together with the front surface of the wall plate when the cover is secured to the wall plate, encloses a standard roll of toilet paper. The cover has a top projection extending from a top of the roll cover portion, so that the top projection extends above a top of the standard roll of toilet paper when the cover is secured to the wall plate and a toilet paper roll is installed. The top projection has an exterior that is curved or inclined downward from an apex to prevent attachment of a ligature, and the exterior of the top projection extends above the bottom roll cover portion by a distance greater than or equal to half of a maximum forward projection of the exterior of the top projection from the planar mounting area of the wall plate to provide sufficient curvature or inclination of the exterior of the top projection of the wall plate. The ligature-resistant toilet paper dispenser also includes a locking mechanism for securing the wall plate to the wall.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present disclosure illustrates toilet paper dispensers that provide ligature-resistant structure and installation. The ligature-resistant toilet paper dispensers have a cover that covers a toilet paper roll and provide an outlet for dispensing the toilet paper at the bottom of the cover. The cover is attached to the wall plate by a hinge assembly. The cover has a curved or inclined shape at the top to which a ligature is not attachable. Ligature-resistance is further provided by a planar mounting surface at the rear of the wall plate and includes a flange that securely affixes the wall plate to the wall at the periphery of the wall plate to prevent insertion of a ligature behind the wall plate. The illustrated example is a molded plastic assembly formed from transparent or semitransparent materials, although the invention is not limited as to materials or techniques of fabrication.

Figure 1:
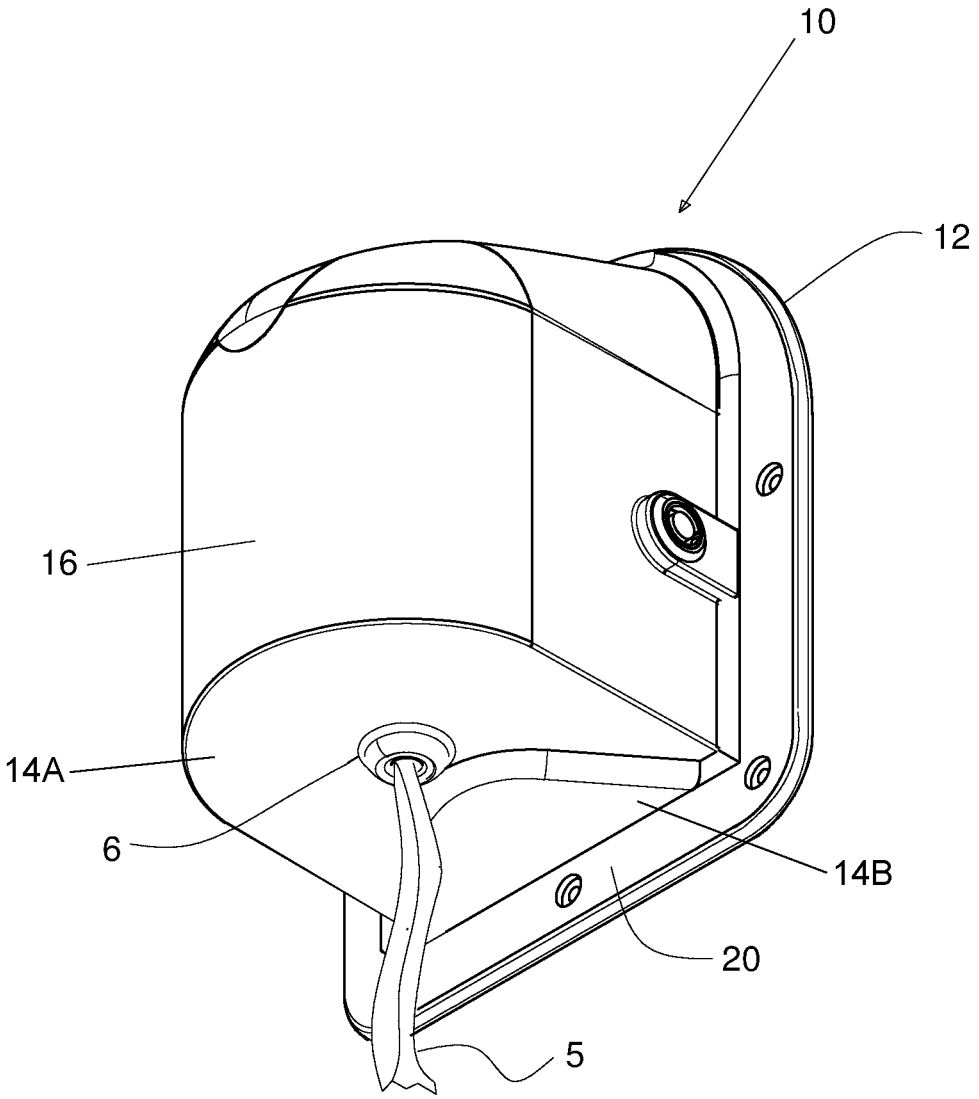
FIG. 1 is a perspective view of an example ligature-resistant toilet paper dispenser 10.

Referring now to FIG. 1, a perspective view of an example ligature-resistant toilet paper dispenser 10 is shown. Example ligature-resistant toilet paper dispenser 10 includes a wall plate 12 and a cover 16 that is secured over the wall plate 12 to enclose a roll of toilet paper. An outlet 6 at a bottom exterior surface 14A of cover 16 permits exit of an end 5 of the roll of toilet paper from the center of the roll in order to dispense one or more toilet paper sheets. Wall plate 12 includes a mounting flange 20 for securing ligature-resistant toilet paper dispenser 10 to a wall. A projection 14B is provided from a front surface of wall plate 12 that supports cover 16 at bottom exterior surface 14A of cover 16. The top of cover is curved downward on the front and sides to prevent attachment of a ligature. The curvature can be extended to a straight line, providing an incline rather than a curved surface.

Figure 2:
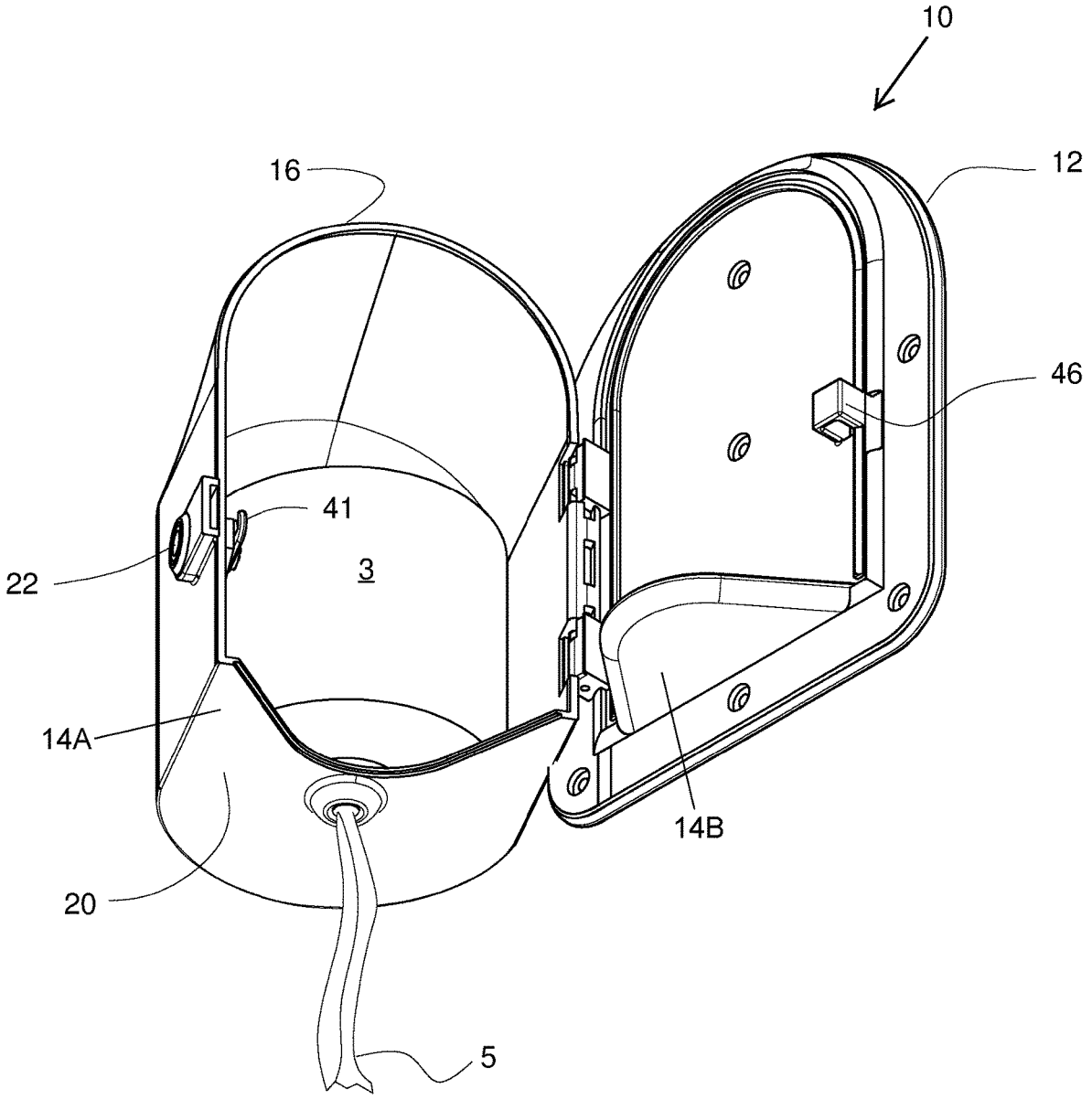
FIG. 2 is a perspective view of example ligature-resistant toilet paper dispenser 10, with cover 16 opened.

Referring now to FIG. 2, a perspective view of example ligature-resistant toilet paper dispenser 10 is shown with cover 16 opened to reveal roll 3 of toilet paper. Roll 3 is vertically-oriented, i.e., the axis around which roll 3 is formed is aligned with the vertical orientation of the wall plate 12 of ligature-resistant toilet paper dispenser 10. In order to install or remove roll 3, cover 16 is opened, as shown. A protrusion 46 is visible inside cover 16, which is engaged by a hook 41 forming part of a locking mechanism 22 provided on cover 16.

Figure 3:
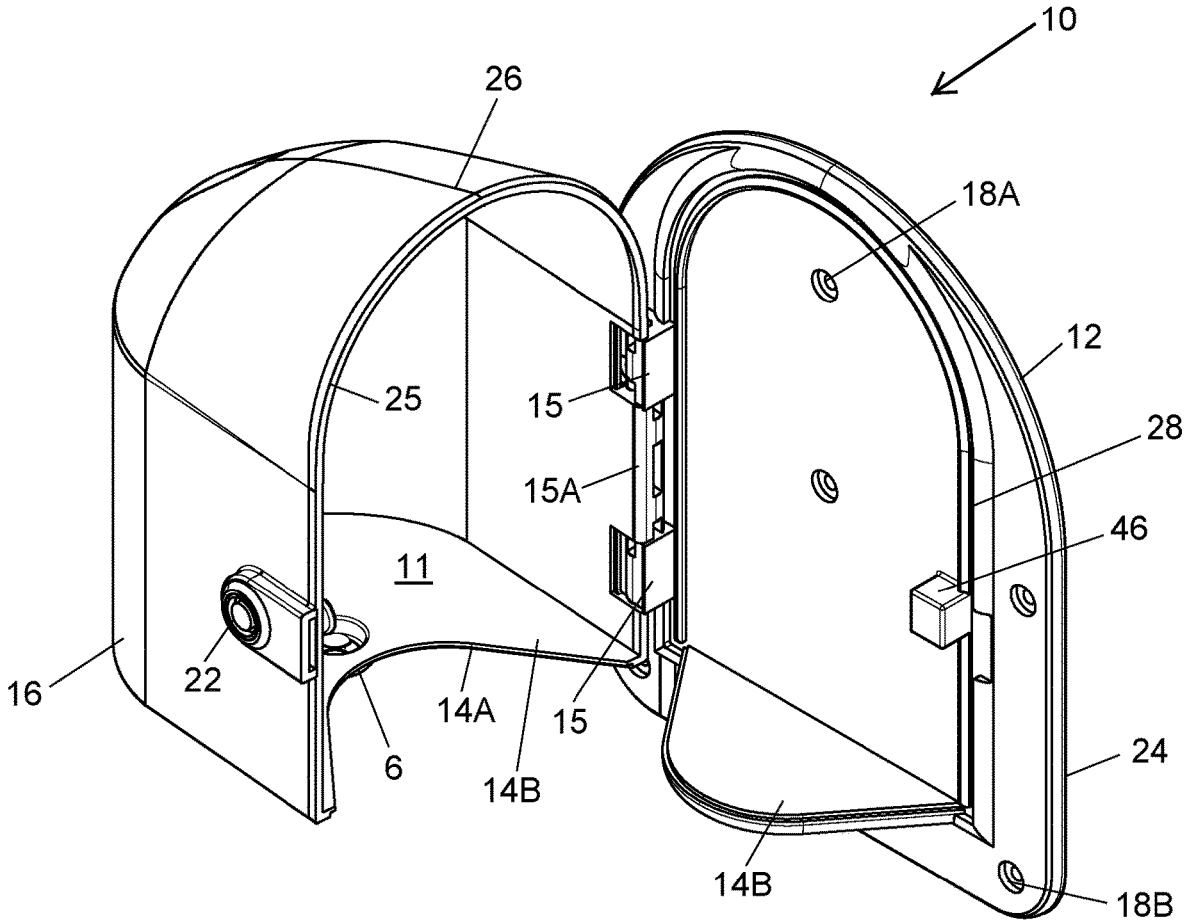
FIG. 3 is a perspective view of the example ligature-resistant toilet paper dispenser 10, with cover 16 opened and toilet paper roll 3 removed.
Figure 12:
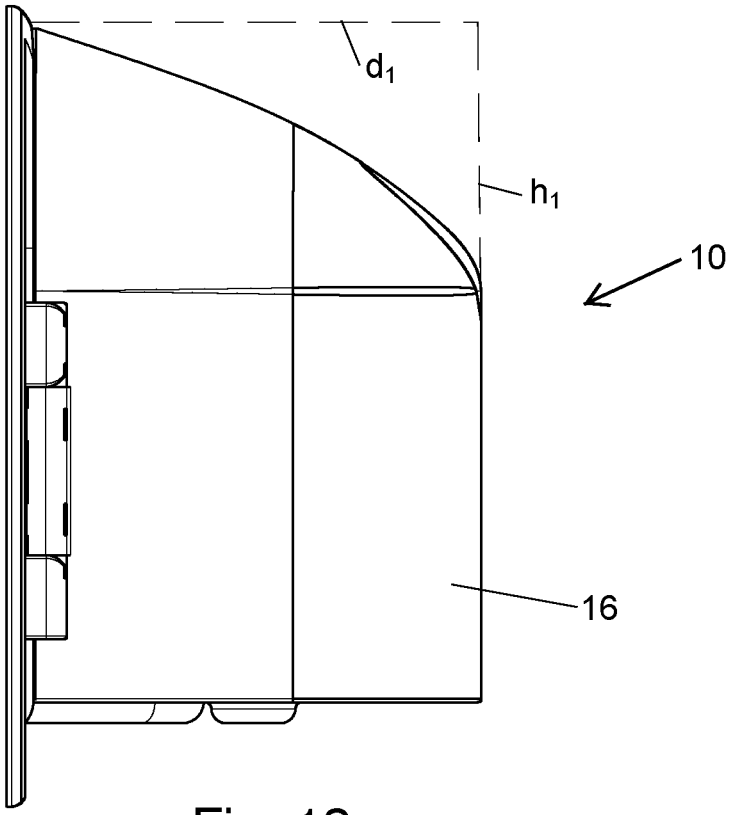
FIG. 12 is a left side view illustrating design features of example ligature-resistant toilet paper dispenser 10.
Figure 14:
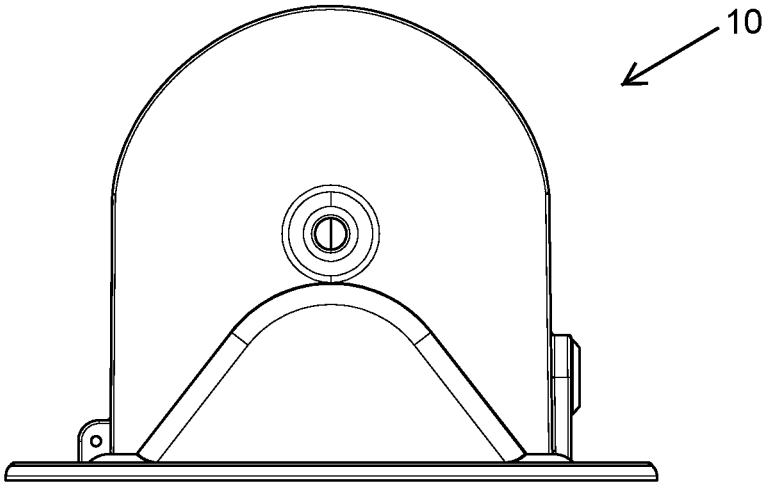
FIG. 14 is a bottom view illustrating design features of example ligature-resistant toilet paper dispenser 10.
Figure 13:
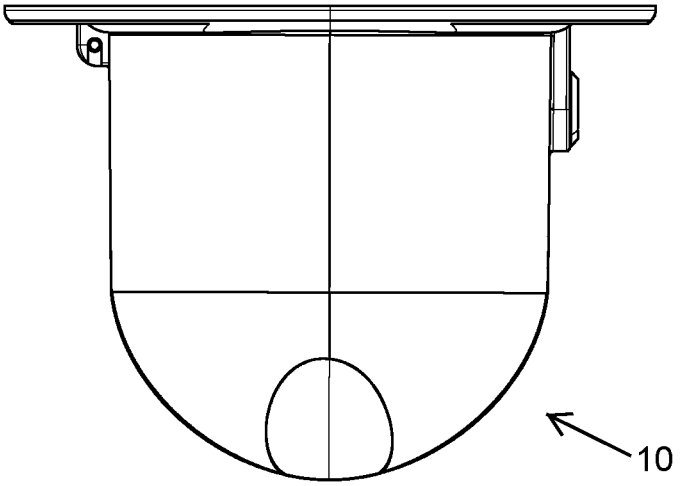
FIG. 13 is a top view illustrating design features of example ligature-resistant toilet paper dispenser 10.

Referring now to FIG. 3, a perspective view of example ligature-resistant toilet paper dispenser 10 is shown with cover 16 opened and roll 3 removed. A hinge assembly is formed by a pin (not shown) that extends through hinge portions 15, 15A formed along the sides of cover 16 and wall plate 12, and that retains cover 16 to wall plate 12. Locking mechanism 22 disposed at the opposite side of cover 16 is used to secure cover 16 over roll 3, when ligature-resistant toilet paper dispenser 10 is available for use. Outlet 6 is formed through cover 16. Mounting voids 18A, 18B for screws, bolts or other suitable fasteners are provided through mounting flange 20 and extend around a planar mounting surface 24 forming a rear surface of wall plate 12, the surface of ligature-resistant toilet paper dispenser 10 that lies flush to a wall when ligature-resistant toilet paper dispenser 10 is installed. Mounting flange 20 surrounds wall plate 12 at the sides of ligature-resistant toilet paper dispenser 10 and extends along the top of wall plate 12 to above an apex 26 of an elongated hemispherical top portion 25 of cover 16. Wall plate 12 forms the back of elongated hemispherical top portion 25 of ligature-resistant toilet paper dispenser 10, by providing a partial circular profile at a blind seam 28 that joins wall plate 12 with cover 16, when cover 16 is secured in a closed position, so that an elongated hemispherical shape is formed for ligature-resistance. Cover 16 includes a partial cylindrical paper recess (bottom) portion 11, so that roll 3 (not shown) rests in paper recess portion 11, as illustrated in FIG. 2, when cover 16 is swung away from wall plate 12. Paper recess portion 11 has a half-circular profile at the front and parallel sides extending from the ends of the half-circular portion extending backward to wall plate 12, as can be seen in FIG. 13 and FIG. 14. Referring additionally to FIG. 12, the side profile of cover 16 is shown in a left side view. The maximum upward projection (height) h1 of cover 16 is slightly greater than half of depth d1 from the maximum forward projection of cover 16 to the wall, providing an elongated hemispherical shape, i.e., a shape that has a circular cross section in the curved portion of top extension of cover 16 from side-to-side and an elongated quarter-elliptical profile from front-to-back. However, a reduced height can provide ligature resistance, and a ratio of height h1 to depth d1 in the range of ½ to 1 are contemplated, as well as steeper inclines in which the ratio of height h1 to depth d1 is greater than 1 and/or the curvature is flattened to provide an inclined surface in either of the forward or lateral directions or both directions.

Figure 4:
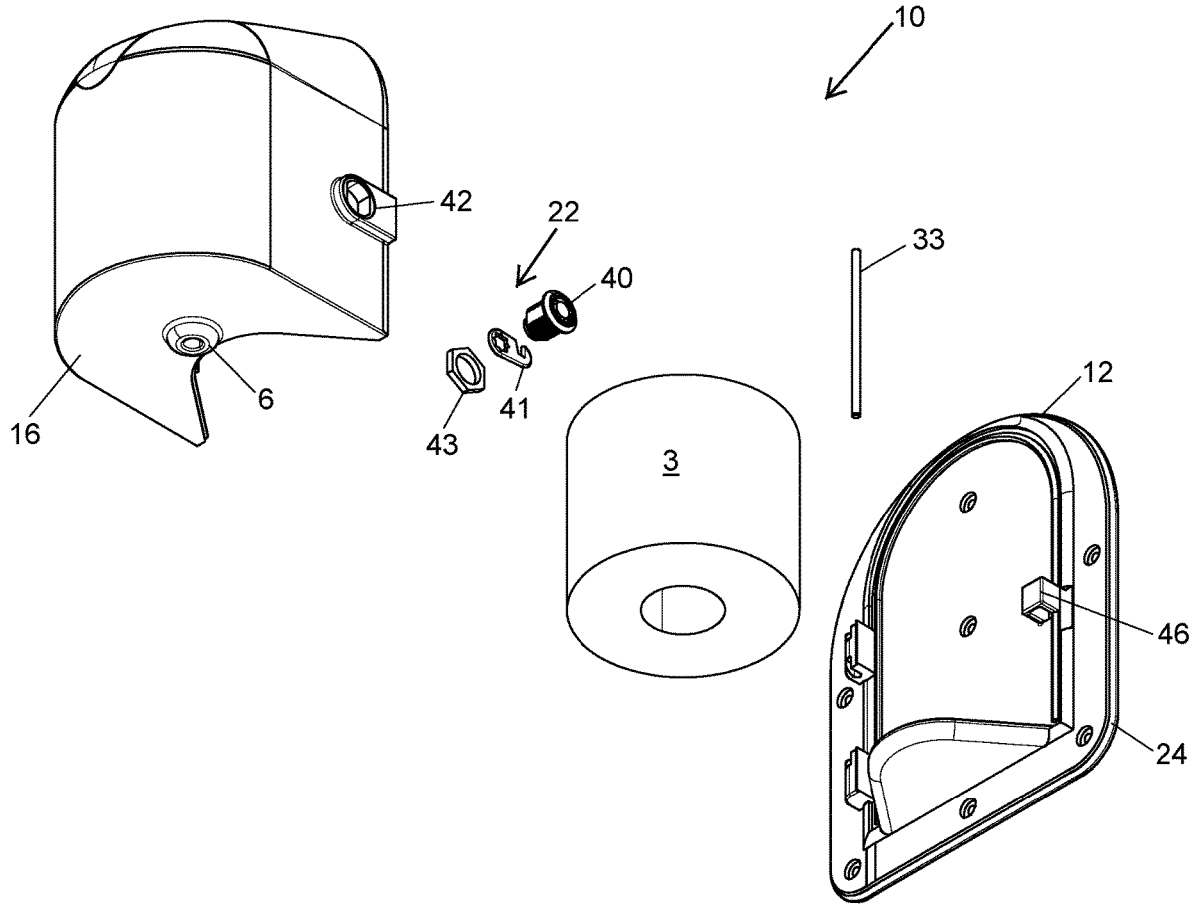
FIG. 4 is an exploded perspective view of the example ligature-resistant toilet paper dispenser 10.

Referring now to FIG. 4, a perspective view of an assembly of example ligature-resistant toilet paper dispenser 10 is shown. The exploded view of FIG. 4 illustrates the relationship of the components of locking mechanism 22 and a hinge pin 33 which is inserted through the portions of hinge portions 15, 15A formed on wall plate 12 and cover 16, respectively. Locking mechanism 22 includes a keylock chamber 40 that is secured in a reinforced hole 42 through cover 16 with a nut 43. Hook 41 is secured to keylock chamber 40 with a bolt or other securing device. Hook 41 latches into a recess in protrusion 46 of cover 16, when a key is turned in keylock chamber 40.

Figure 5:
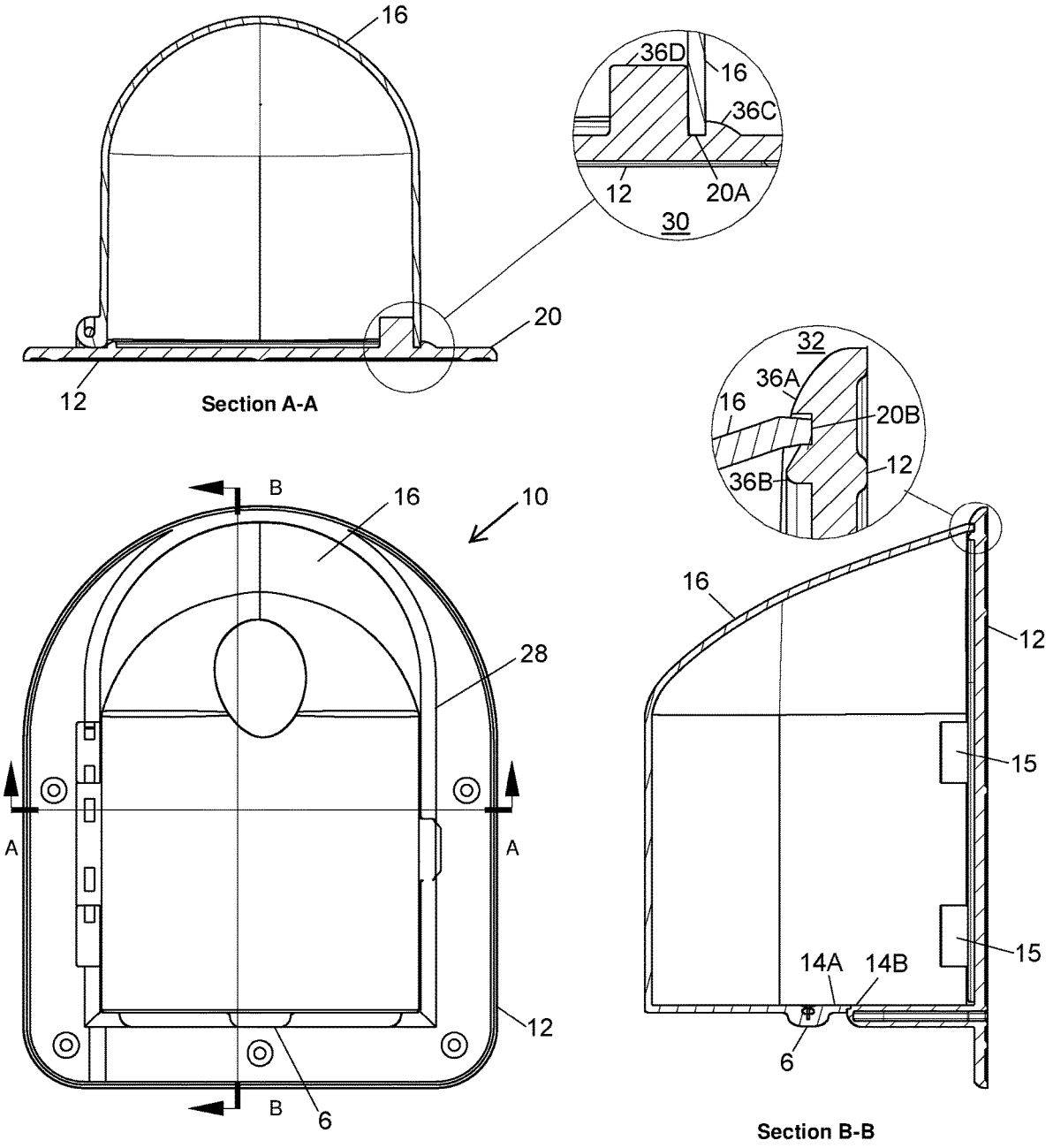
FIG. 5 is a front sectional view showing details of example ligature-resistant toilet paper dispenser 10.

Referring now to FIG. 5, a front sectional view of ligature-resistant toilet paper dispenser 10 is shown. Section A-A shows the profile of a lower region of cover 16 which is semi-circular at the front thereof and has parallel sides extending from mounting flange 20 to the semi-circular portion of the profile of cover 16. Blind seam 28 is provided completely around cover 16 with the exception of bottom exterior surface 14A of cover 16, so that no gap is provided for insertion of a ligature at the sides and top of ligature-resistant toilet paper dispenser 10. Detail 30 shows a blind seam connection provided between wall plate 12 and cover 16 forming part of the blind seam 28 prevents insertion of a ligature at the joint between cover 16 and a groove 20A formed between a projection 36C at the edge of mounting flange 20 and a projection 36D on the front surface of wall plate 12 adjacent to the interior of cover 16 when cover 16 is secured. Detail 32 shows a seal provided by a groove 20B formed by double-ridged profile provided by ridges 36A, 36B on the front surface of wall plate 12 and the edge of cover 16, forming the remainder of the blind seam 28, which also prevents insertion of a ligature. Referring additionally to FIG. 3, the interface of bottom exterior surface 14A of cover 16 and projection 14B of wall plate 12 form a shiplap interface at the bottom of ligature-resistant toilet paper dispenser 10, preventing insertion of a ligature at the bottom of cover 16, which is visible in section-BB and the individual profiles of which are visible in FIG. 3.

Figure 6:
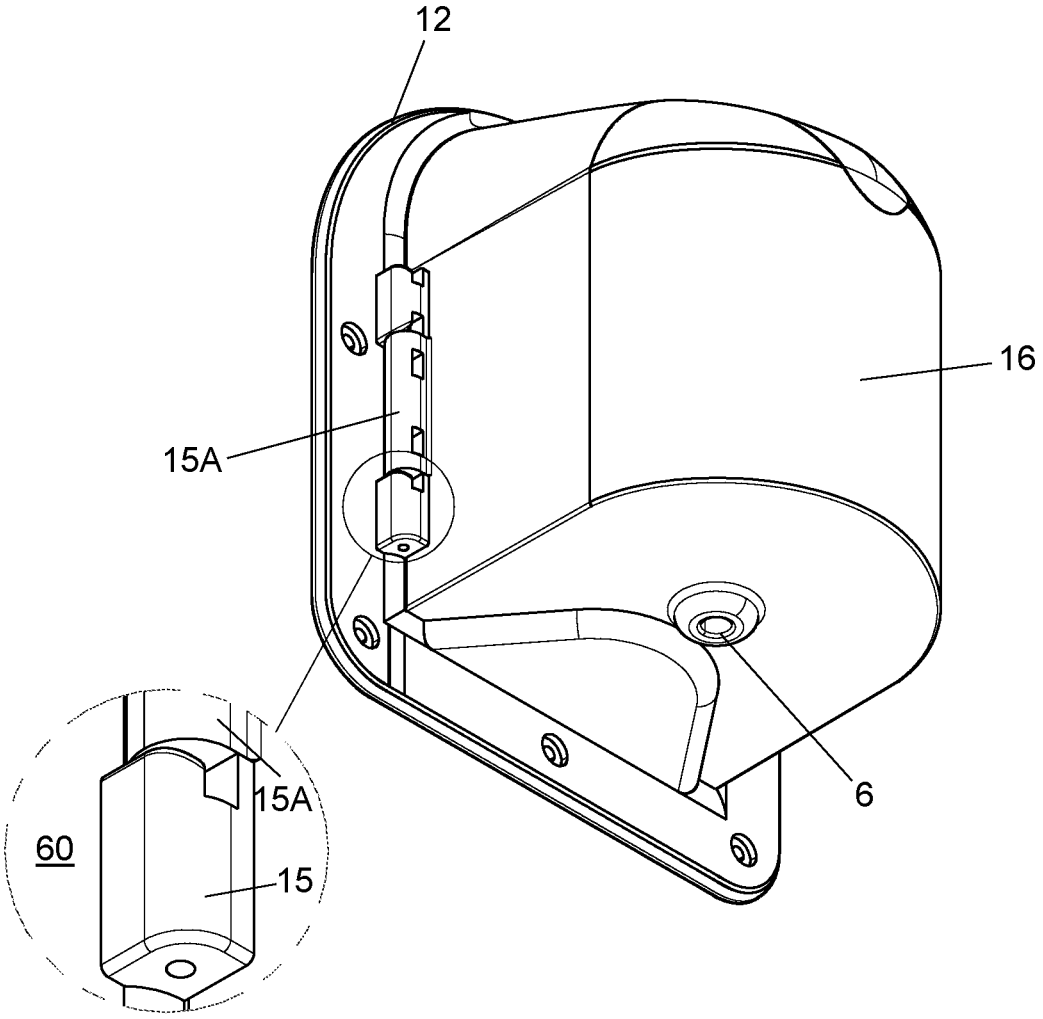
FIG. 6 is a perspective view illustrating details of a hinge of example ligature-resistant toilet paper dispenser 10.

Referring now to FIG. 6, a perspective view of ligature-resistant toilet paper dispenser 10 illustrates further details of hinge formed by hinge portions 15 and 15A. Detail 60 shows the interface between hinge portion 15 and hinge portion 15A does not provide a gap, so that a ligature cannot be looped through or placed between hinge portions 15 and 15A.

Figure 7:
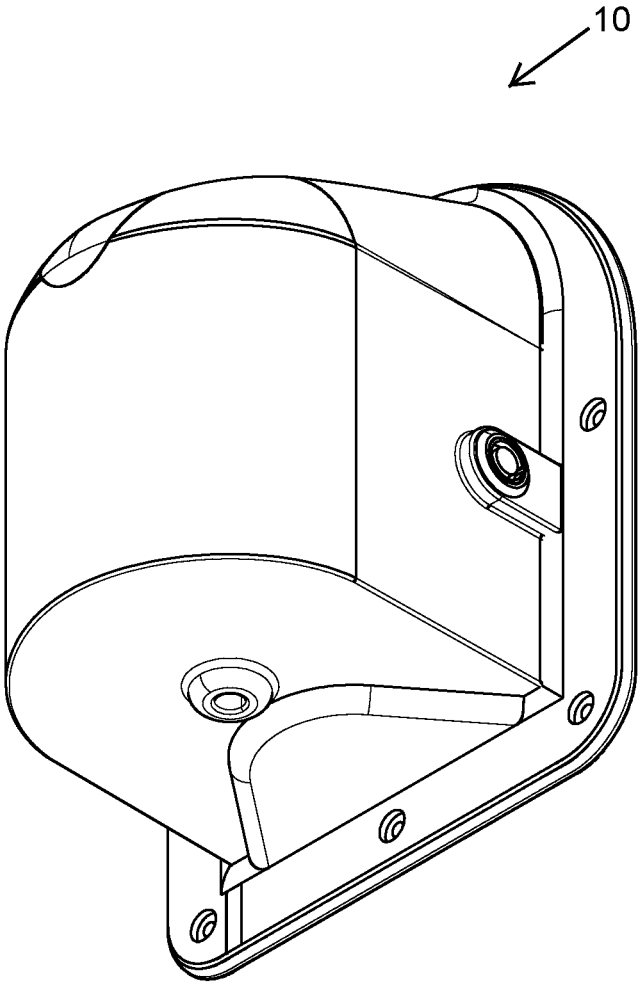
FIG. 7 is a lower-right perspective view illustrating design features of example ligature-resistant toilet paper dispenser 10.
Figure 8:
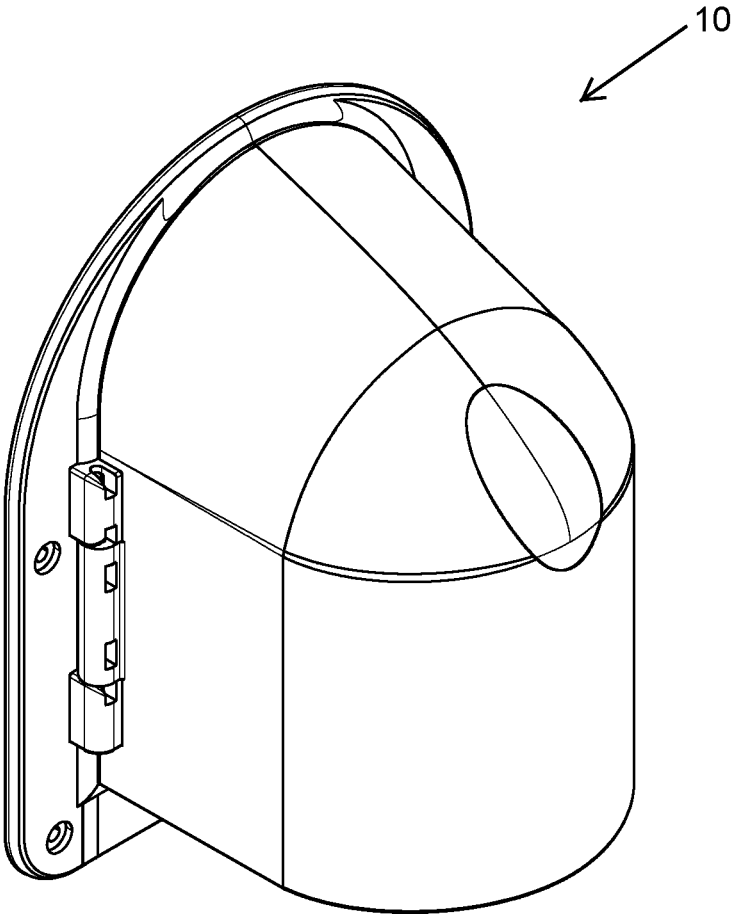
FIG. 8 is an upper-left perspective view illustrating design features of example ligature-resistant toilet paper dispenser 10.
Figure 9:
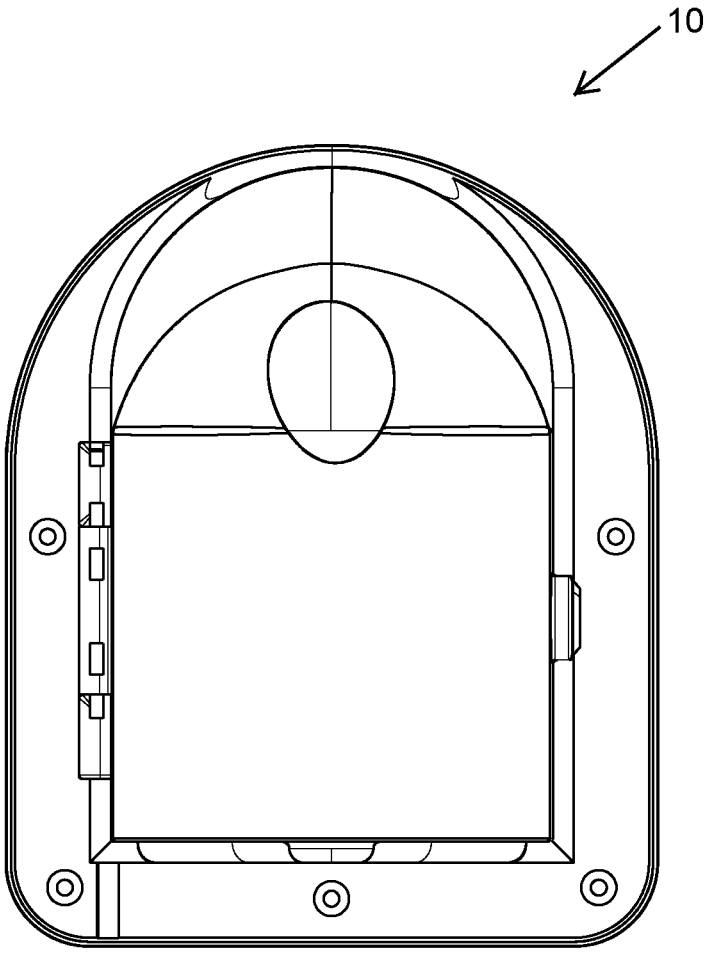
FIG. 9 is a front view illustrating design features of example ligature-resistant toilet paper dispenser 10.
Figure 10:
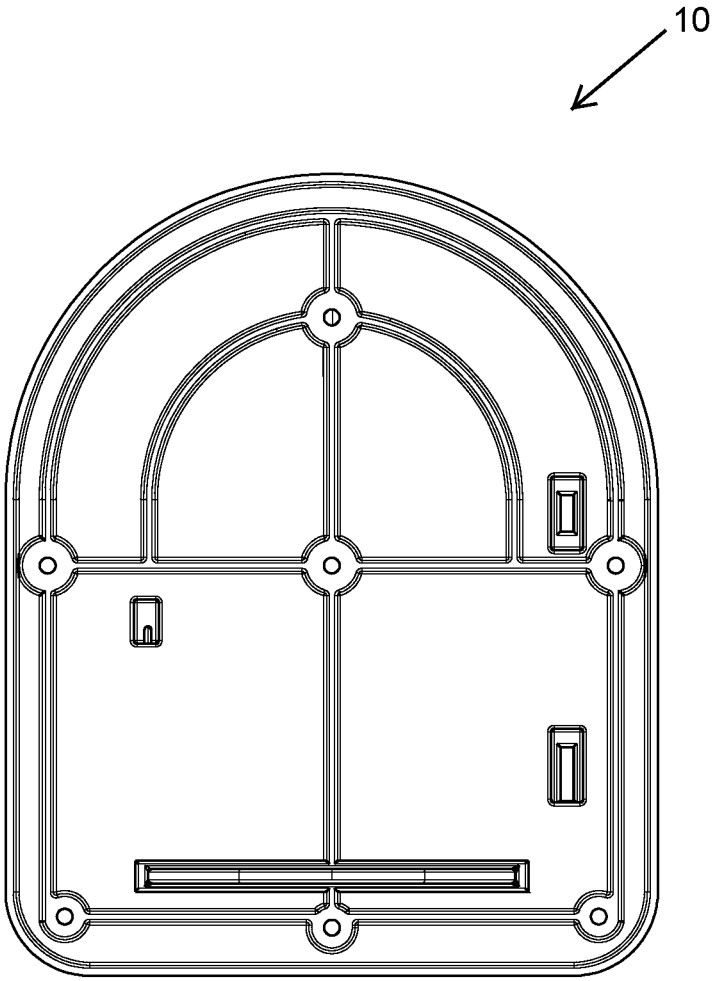
FIG. 10 is a rear view illustrating design features of example ligature-resistant toilet paper dispenser 10.
Figure 11:
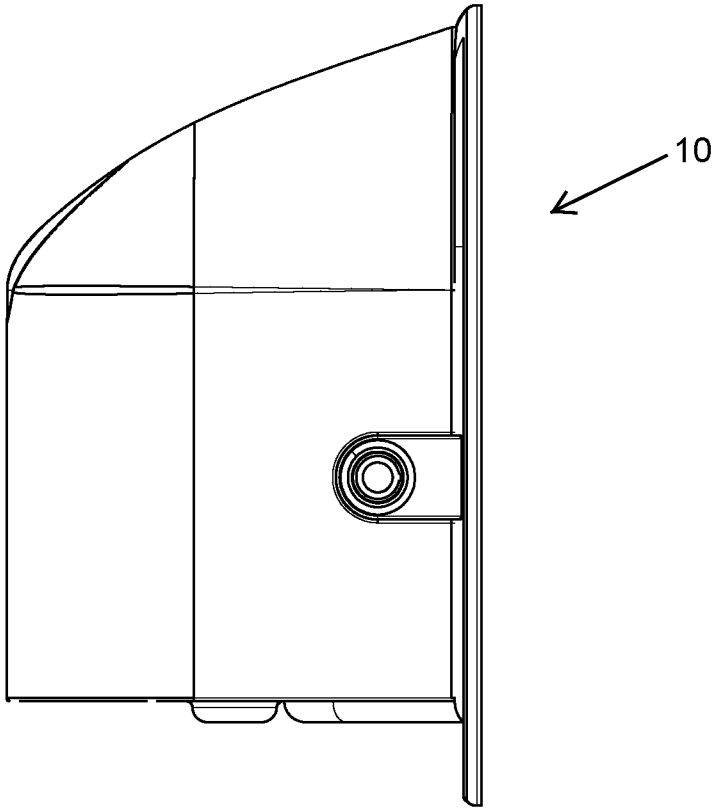
FIG. 11 is a right side view illustrating design features of example ligature-resistant toilet paper dispenser 10.

FIG. 7 through FIG. 14 depict design features of example ligature-resistant toilet paper dispenser 10, in which FIG. 7 is a lower-right perspective view, FIG. 8 is an upper-left perspective view, FIG. 9 is a front view, FIG. 10 is a rear view, FIG. 11 is a right side view, FIG. 12 is a left side view, FIG. 13 is a top view and FIG. 14 is a bottom view illustrating design features of the above-described example ligature-resistant toilet paper dispenser 10.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A ligature-resistant toilet paper dispenser comprising:

a wall plate having a rear face providing a planar mounting area for securing the ligature-resistant toilet paper dispenser to a wall;

a cover rotatably coupled to the wall plate by a hinge and providing a cover bottom portion providing a paper recess for receiving a roll of toilet paper such that a central axis of the roll of toilet paper is oriented along a vertical direction, and a cover top portion extending upward from a top edge of the cover bottom portion and having an exterior that is curved or inclined downward from an apex to prevent attachment of a ligature, wherein the exterior of the cover top portion extends above the paper recess by a distance greater than or equal to half of a maximum forward projection of the exterior of the cover top portion from the rear face of the wall plate wall to provide sufficient curvature or inclination of the exterior of the ligature-resistant toilet paper dispenser to prevent attachment of a ligature, wherein the cover has an outlet provided through a bottom face of the cover bottom portion through which an end of the roll of toilet paper is extendable for dispensing toilet paper from the roll of toilet paper, and wherein the wall plate has a wall plate top portion that extends above the cover when the cover is secured to the wall plate and a wall plate bottom portion that extends beyond the cover on a first side and a second side of the cover and below a bottom surface of the cover bottom portion to prevent insertion of a ligature behind the cover; and a locking mechanism disposed on the cover opposite the hinge for securing the cover over the roll of toilet paper.

2. The ligature-resistant toilet paper dispenser of claim 1, wherein the cover top portion has an elongated hemispherical shape.

3. The ligature-resistant toilet paper dispenser of claim 1, wherein the wall plate comprises a projection that extends beneath a bottom surface of the cover bottom portion to support the cover when the cover is secured to the wall plate, wherein the projection extends substantially across a rear edge of the bottom surface of the cover bottom portion and tapers to a curved front edge to mate with a corresponding cut-out in the bottom surface of the cover bottom portion near the outlet.

4. The ligature-resistant toilet paper dispenser of claim 3, wherein the projection has a groove that receives a rear edge of the cut-out in the bottom surface of the cover bottom portion to prevent insertion of a ligature.

5. The ligature-resistant toilet paper dispenser of claim 1, further comprising at least one first hinge portion formed on a first side of the wall plate, a corresponding at least one second hinge portion formed on the first side of the cover and one or more pins that secure the cover to the wall plate by extending through the at least one first hinge portion and the at least one second hinge portion.

6. The ligature-resistant toilet paper dispenser of claim 1, wherein the cover bottom portion has a half-circular profile at a front edge thereof and parallel sides extending rearward to the wall plate when the cover is secured to the wall plate.

7. The ligature-resistant toilet paper dispenser of claim 1, further comprising at least one mounting void extending from within the wall plate top portion through the planar mounting area for securing the wall plate to the wall.

8. The ligature-resistant toilet paper dispenser of claim 1, wherein the planar mounting area of the wall plate includes a flange extending completely around the periphery of the wall plate.

9. The ligature-resistant toilet paper dispenser of claim 8, wherein the wall plate comprises a projection that extends beneath the bottom surface of the cover bottom portion to support the cover when the cover is secured to the wall plate, wherein the projection extends substantially across a rear edge of the bottom surface of the cover bottom portion and tapers to a curved front edge to mate with a corresponding cut-out in the bottom surface of the cover bottom portion near the outlet, so that the flange extends across the wall plate beneath the projection.

10. The ligature-resistant toilet paper dispenser of claim 1, wherein the cover top portion defines an empty volume extending from a top of the cover bottom portion and to an inner surface of the wall plate top portion when the roll of toilet paper is installed and the cover is secured to the wall plate.

11. A ligature-resistant toilet paper dispenser, comprising:

a wall plate having a rear face providing a planar mounting area for securing the ligature-resistant toilet paper dispenser to a wall;

a cover rotatably coupled to the wall plate by a hinge and providing a cover bottom portion providing a paper recess for receiving a roll of toilet paper such that a central axis of the roll of toilet paper is oriented along a vertical direction, and a cover top portion extending upward from a top edge of the cover bottom portion and having an exterior that is curved or inclined downward from an apex to prevent attachment of a ligature, wherein the exterior of the cover top portion extends above the paper recess by a distance greater than or equal to half of a maximum forward projection of the exterior of the cover top portion from the rear face of the the wall plate wall to provide sufficient curvature or inclination of the exterior of the ligature-resistant toilet paper dispenser to prevent attachment of a ligature, wherein the cover has an outlet provided through a bottom face of the cover bottom portion through which an end of the roll of toilet paper is extendable for dispensing toilet paper from the roll of toilet paper, and wherein the wall plate has a wall plate top portion that extends above the cover when the cover is secured to the wall plate and a wall plate bottom portion that extends beyond the cover on a first side and a second side of the cover and below a bottom surface of the cover bottom portion to prevent insertion of a ligature behind the cover, and wherein the cover bottom portion has a half-circular profile at a front edge thereof and parallel sides extending rearward to the wall plate when the cover is secured to the wall plate, wherein the wall plate bottom portion comprises a projection that extends beneath the bottom surface of the cover bottom portion to support the cover when the cover is secured to the wall plate, wherein the projection extends substantially across a rear edge of the bottom surface of the cover bottom portion and tapers to a curved front edge to mate with a corresponding cut-out in the bottom surface of the cover bottom portion near the outlet, wherein the projection has a groove that receives a rear edge of the cut-out in the bottom surface of the cover bottom portion to prevent insertion of a ligature, wherein the cover and the wall plate join at a blind seal extending around the apex of the cover top portion and along both sides of the wall plate to prevent insertion of a ligature, wherein the planar mounting area of the wall plate includes a flange extending completely around the periphery of the wall plate, so that the flange extends across the wall plate beneath the projection, wherein the cover top portion and the wall plate top portion define an empty volume above the cover bottom portion that extends to the interior of the wall plate directly beneath the apex;

at least one first hinge portion formed on the first side of the wall plate, a corresponding at least one second hinge portion formed on a corresponding first side of the cover and one or more pins that secure the cover to the wall plate rear portion by extending through the at least one first hinge portion and the at least one second hinge portion; and a locking mechanism disposed on the cover opposing the hinge for securing the cover over the roll of toilet paper.

12. A method of dispensing toilet paper, while preventing formation or support of a ligature at the location of the dispensing, the method comprising:

mounting a wall plate of a ligature-resistant toilet paper dispenser to a wall, by securing a planar mounting area provided at a rear face of the wall plate, wherein the wall plate has a wall plate top portion and a wall plate bottom portion;

attaching a cover to the wall plate by a hinge, wherein the cover has a cover bottom portion providing a paper recess for receiving a roll of toilet paper such that a central axis of the roll of toilet paper is oriented along a vertical direction, wherein the cover has a cover top portion extending upward from a top edge of the cover bottom portion and has an exterior that is curved or inclined downward from an apex to prevent attachment of a ligature, wherein the exterior of the cover top portion extends above the paper recess by a distance greater than or equal to half of a maximum forward projection of the exterior of the cover top portion from the rear face of the wall plate wall to provide sufficient curvature or inclination of the exterior of the ligature-resistant toilet paper dispenser to prevent attachment of a ligature;

inserting the roll of toilet paper into the paper recess;

securing the wall plate over the roll of toilet paper with a locking mechanism disposed on the cover opposite the hinge, so that the wall plate top portion extends above the cover and the wall plate bottom portion extends beyond the cover on the first side and the second side of the cover and below a bottom surface of the cover bottom portion to prevent insertion of a ligature behind the cover; and dispensing the toilet paper from an outlet provided through the bottom surface of the cover bottom portion through which an end of the roll of toilet paper extends for dispensing the toilet paper, and wherein the wall plate top portion extends above the apex of the cover top portion when the cover is secured to the wall plate, wherein the wall plate extends beyond the cover on a first side and the second side of the cover and below the bottom surface of the cover bottom portion to prevent insertion of a ligature behind the cover.

13. The method of claim 12, wherein the cover top portion has an elongated hemispherical shape.

14. The method of claim 13, wherein the top portion of the cover defines an empty volume extending from a top of the cover bottom portion and to an the interior of the wall plate top portion when the roll of toilet paper is installed and the cover is secured to the wall plate.

15. The method of claim 12, wherein the wall plate comprises a projection that extends beneath a bottom surface of the cover bottom portion to support the cover when the cover is secured to the wall plate, wherein the projection extends substantially across a rear edge of the bottom surface of the cover bottom portion and tapers to a curved front edge to mate with a corresponding cut-out in a bottom surface of the cover bottom portion near the outlet.

16. The method of claim 15, wherein the projection has a groove that receives a rear edge of the cut-out in the bottom surface of the cover bottom portion to prevent insertion of a ligature.

17. The method of claim 12, wherein the attaching is provided by at least one first hinge portion formed on the first side of the wall plate, a corresponding at least one second hinge portion formed on a corresponding first side of the cover and one or more pins that secure the cover to the wall plate rear portion by extending through the at least one first hinge portion and the at least one second hinge portion.

18. The method claim 12, wherein the cover bottom portion has a half-circular profile at a front edge thereof and parallel sides extending rearward to the wall plate when the cover is secured to the wall plate.

19. The method of claim 12, wherein the planar mounting area includes a flange extending completely around the periphery of the wall plate.

20. The method of claim 19, wherein the wall plate comprises a projection that extends beneath the bottom surface of the cover bottom portion to support the cover when the cover is secured to the wall plate, so that the projection extends substantially across a rear edge of the bottom surface of the cover bottom portion and tapers to a curved front edge to mate with a corresponding cut-out in the bottom surface of the cover bottom portion near the outlet, so that the flange extends across the wall plate beneath the projection.

* * * * *